US011674201B2

(12) United States Patent
Kang

(10) Patent No.: US 11,674,201 B2
(45) **Date of Patent: *Jun. 13, 2023**

(54) HIGH THERMAL CONDUCTIVE CASTING ALUMINUM ALLOY AND MANUFACTURING METHOD THEREOF

(71) Applicants: HYUNDAI MOTOR COMPANY, Seoul (KR); KIA CORPORATION, Seoul (KR)

(72) Inventor: Heesam Kang, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/497,751

(22) Filed: Oct. 8, 2021

(65) Prior Publication Data

US 2022/0127699 A1 Apr. 28, 2022

(30) Foreign Application Priority Data

Oct. 27, 2020 (KR) ..... 10-2020-0140202

(51) Int. Cl.
*C22C 21/00* (2006.01)
*C22C 1/02* (2006.01)

(52) U.S. Cl.
CPC ..... *C22C 21/00* (2013.01); *C22C 1/026* (2013.01)

(58) Field of Classification Search
CPC ..... C22C 1/026; C22C 21/00
USPC ..... 420/532
See application file for complete search history.

(56) References Cited

U.S. PATENT DOCUMENTS 5,489,347 A * 2/1996 Himuro ..... F28F 1/126 420/548
6,387,540 B1 * 5/2002 Yoshidomi ..... F28F 21/084 138/143
10,822,675 B2 * 11/2020 Sanaty-Zadeh ..... C22F 1/04
2022/0145431 A1 * 5/2022 Kang ..... C22C 21/00

FOREIGN PATENT DOCUMENTS

WO WO-2017133415 A1 * 8/2017

OTHER PUBLICATIONS

NPL: on-line translation of WO-2017133415-A1, Aug. 2017 (Year: 2017).*

* cited by examiner

*Primary Examiner* — Jie Yang
(74) *Attorney, Agent, or Firm* — Lempia Summerfield Katz LLC

(57) ABSTRACT

A high thermal conductive casting aluminum alloy is provided as an Al—Ni—Fe-based alloy, including, based on an entire alloy of 100 wt %, nickel (Ni) added at 1.0 to 1.3 wt %, iron (Fe) added at 0.3 to 0.9 wt %, and aluminum (Al) added as a balance.

8 Claims, 12 Drawing Sheets

HIGH THERMAL CONDUCTIVE CASTING ALUMINUM ALLOY AND MANUFACTURING METHOD THEREOF

CROSS-REFERENCE TO RELATED APPLICATION

This application claims priority to and the benefit of Korean Patent Application No. 10-2020-0140202 filed in the Korean Intellectual Property Office on Oct. 27, 2020, the entire contents of which are incorporated herein by reference.

BACKGROUND

(a) Field of the Disclosure

The present disclosure relates to a high thermal conductive casting aluminum alloy, and more particularly, to a high thermal conductive casting aluminum alloy having thermal conductivity of 200 W/mK or more.

(b) Description of the Related Art

A high thermal conductive aluminum alloy is used for vehicle parts that quickly transmit heat by contacting a heating element such as a heat sink.

Although pure aluminum (Al) has the highest thermal conductivity, it is not widely used because of its poor mechanical properties and productivity.

Instead, in order to secure basic casting properties and minimum physical properties, alloys with minimal additive elements are used as high thermal conductive alloys, which may be classified into extruded materials and casting materials.

Although the extruded material has excellent thermal conductivity, there is a problem of high cost when manufacturing parts because a material price is high and casting properties are inferior. Thermal conductivity of the casting material is approximately 160 W/mK. Thus, the casting material is inferior in thermal conductive characteristics or inferior in hot crack characteristics. When the casting material has thermal conductivity of approximately 160 W/mK, a heat dissipation characteristic thereof is at least 20% lower than that of the extruded material.

As such, development of an aluminum alloy casting material with improved thermal conductivity and improved hot crack characteristic is useful.

The above information disclosed in this Background section is only to enhance understanding of the background of the disclosure. Therefore, the Background section may contain information that does not form the prior art that is already known in this country to a person having ordinary skill in the art.

SUMMARY

The present disclosure is made in an effort to provide a high thermal conductive casting aluminum alloy that has thermal conductivity of 200 W/mK or more and an excellent hot crack characteristic.

An embodiment of the present disclosure provides a high thermal conductive casting aluminum alloy as an Al—Ni—Fe-based alloy, including, based on an entire alloy of 100 wt %, nickel (Ni) at 1.0 to 1.3 wt %; iron (Fe) at 0.3 to 0.9 wt %; and aluminum (Al) as a balance.

A sum (Ni+Fe) of contents of the nickel and the iron may be 1.6 wt % or more.

A eutectic $FeNiAl_9$ phase in the alloy may be 5 wt % or more.

A sum (Ni+Fe) of contents of the nickel and the iron may be 1.9 wt % or less.

A content of the iron may be equal to or less than that of the nickel.

A fraction of an Al matrix phase in the alloy may be 94 wt % or more.

Thermal conductivity of the alloy may be 200 W/mK or more.

The alloy may further include manganese (Mn) at 0.1 to 0.4 wt %.

Thermal conductivity of the alloy may be 205 W/mK or more.

The alloy may further include other alloy elements.

A content of the other alloy elements may be 0.5 wt % or less based on a total amount of the alloy. The other alloy elements may include at least one of copper (Cu), magnesium (Mg), and silicon (Si).

A content of the copper (Cu) may be 0.2 wt % or less based on the total amount of the alloy.

A content of the magnesium (Mg) may be 0.3 wt % or less based on the total amount of the alloy.

A content of the silicon (Si) may be 0.3 wt % or less based on the total amount of the alloy.

Another embodiment of the present disclosure provides a manufacturing method of a high thermal conductive casting aluminum alloy, including dissolving aluminum and adding iron (Fe) and nickel (Ni) to the dissolved aluminum.

The adding of the iron (Fe) and the nickel (Ni) may be include adding nickel (Ni) at 1.0 to 1.3 wt %, iron (Fe) at 0.3 to 0.9 wt %, and a balance of aluminum (Al) based on 100 wt % of the entire alloy.

The adding of the iron (Fe) and the nickel (Ni) may include adding an amount in which a sum (Ni+Fe) of contents of the nickel and the iron is 1.6 to 1.9 wt %.

A fraction of a eutectic $FeNiAl_9$ phase of the manufactured alloy may be 5 wt % or more.

A fraction of an Al matrix phase of the manufactured alloy may be 94 wt % or more.

In the adding of the iron (Fe) and the nickel (Ni), based on an entire alloy of 100 wt %, copper (Cu) at 0.2 wt % or less may be satisfied.

In the adding of the iron (Fe) and the nickel (Ni), based on an entire alloy of 100 wt %, magnesium (Mg) at 0.3 wt % or less may be satisfied.

In the adding of the iron (Fe) and the nickel (Ni), based on an entire alloy of 100 wt %, silicon (Si) at 0.3 wt % or less may be satisfied.

The present disclosure relates to a high thermal conductive casting aluminum alloy that has thermal conductivity of 200 W/mK or more and has an improved hot crack characteristic.

In addition, the alloy of the present disclosure is a non-heat treatment type of alloy capable of obtaining maximum thermal conductivity even without a special heat treatment, so that an additional process cost may be reduced.

In other words, according to the aluminum alloy of the present disclosure, it is possible to reduce a manufacturing cost and to improve thermal conductivity by 120% compared with the existing casting aluminum alloy. Accordingly, it is possible to increase cooling efficiency.

DETAILED DESCRIPTION OF THE EMBODIMENTS

Hereinafter, embodiments of the present disclosure are described in detail. The embodiments, however, are provided as examples, and the present disclosure is not limited thereto but is defined within the range of claims described below.

In the present specification, unless explicitly described to the contrary, the word "comprise" and variations such as "comprises" or "comprising" should be understood to imply the inclusion of stated elements but not the exclusion of any other elements.

In the present specification, an expression used in the singular encompasses the expression of the plural, unless it has a clearly different meaning in the context. In the specification, it is to be understood that the terms such as "including", "having", etc., are intended to indicate the existence of specific features, regions, numbers, stages, operations, elements, components, and/or combinations thereof disclosed in the specification, and are not intended to preclude the possibility that one or more other features, regions, numbers, stages, operations, elements, components, and/or combinations thereof may exist or may be added. Further, as used herein, the singular forms "a", "an", and "the" are intended to include the plural forms as well, unless the context clearly indicates otherwise.

All terms used herein, including technical or scientific terms, have the same meanings as those generally understood by those having ordinary skill in the art to which the present disclosure belongs. Terms defined in commonly used dictionaries are further interpreted as having meanings consistent with the relevant technical literature and the present disclosure. Such terms are not to be construed as having idealized or formal meanings unless defined otherwise.

In some embodiments, detailed description of well-known technologies has been omitted to prevent the disclosure of the present disclosure from being interpreted ambiguously.

In addition, a manufacturing method of a high thermal conductive casting aluminum alloy according to an embodiment of the present disclosure may further include additional processes in addition to suggested processes.

In the embodiments of the present disclosure, the meaning of further including other alloy elements means replacing the balance aluminum (Al) by an additional amount of other elements.

High Thermal Conductive Casting Aluminum Alloy

The alloy of the present disclosure is an Al—Ni—Fe-based alloy.

The Al—Ni—Fe-based alloy of the present disclosure may include 1.0 to 1.3 wt % of nickel (Ni), 0.3 to 0.9 wt % of iron (Fe), and a balance of aluminum (Al), based on 100 wt % of an entire alloy.

The alloy that satisfies the above-mentioned condition may be an aluminum alloy having high thermal conductivity and excellent casting properties.

It may secure excellent casting properties compared with pure aluminum while maintaining high thermal conductivity, by adding nickel (Ni) and iron (Fe).

Figure 1:
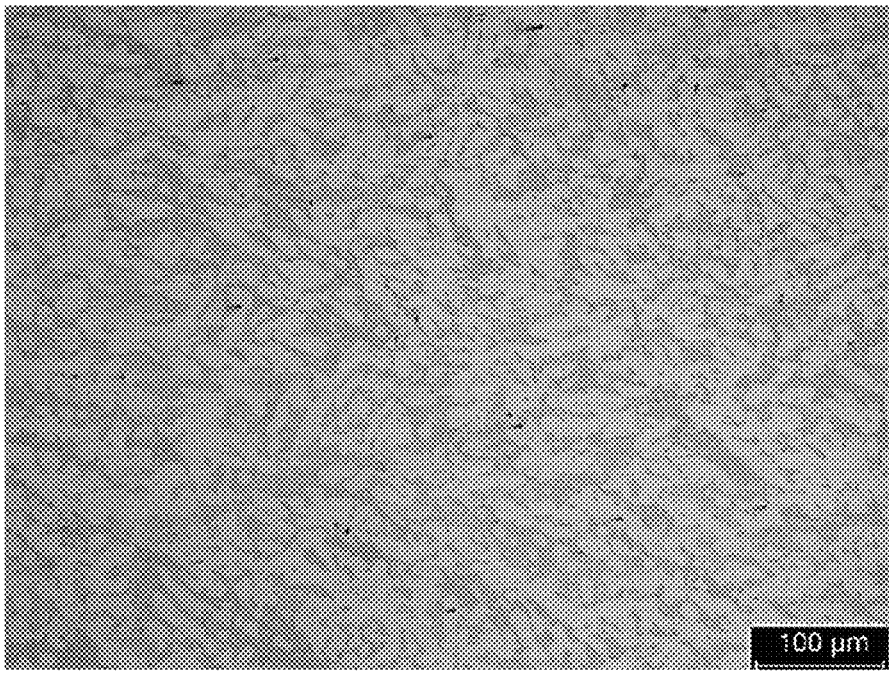
FIG. 1 illustrates a photograph of a microstructure of an Al—Ni—Fe-based alloy according to an embodiment of the present disclosure.
Figure 2:
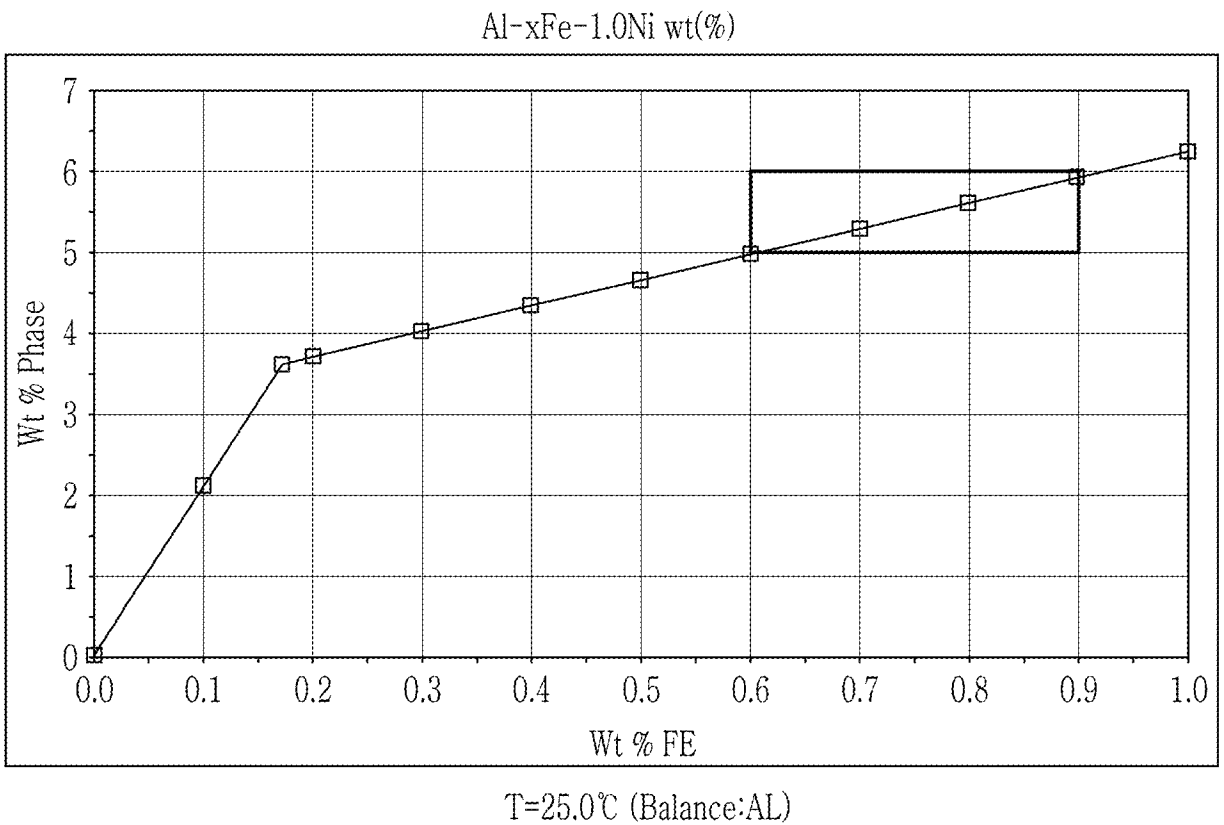
FIG. 2 illustrates a graph of a phase fraction of eutectic $FeNiAl_9$ according to a content of iron (Fe) when a content of nickel (Ni) is 1.0 wt %.
Figure 3:
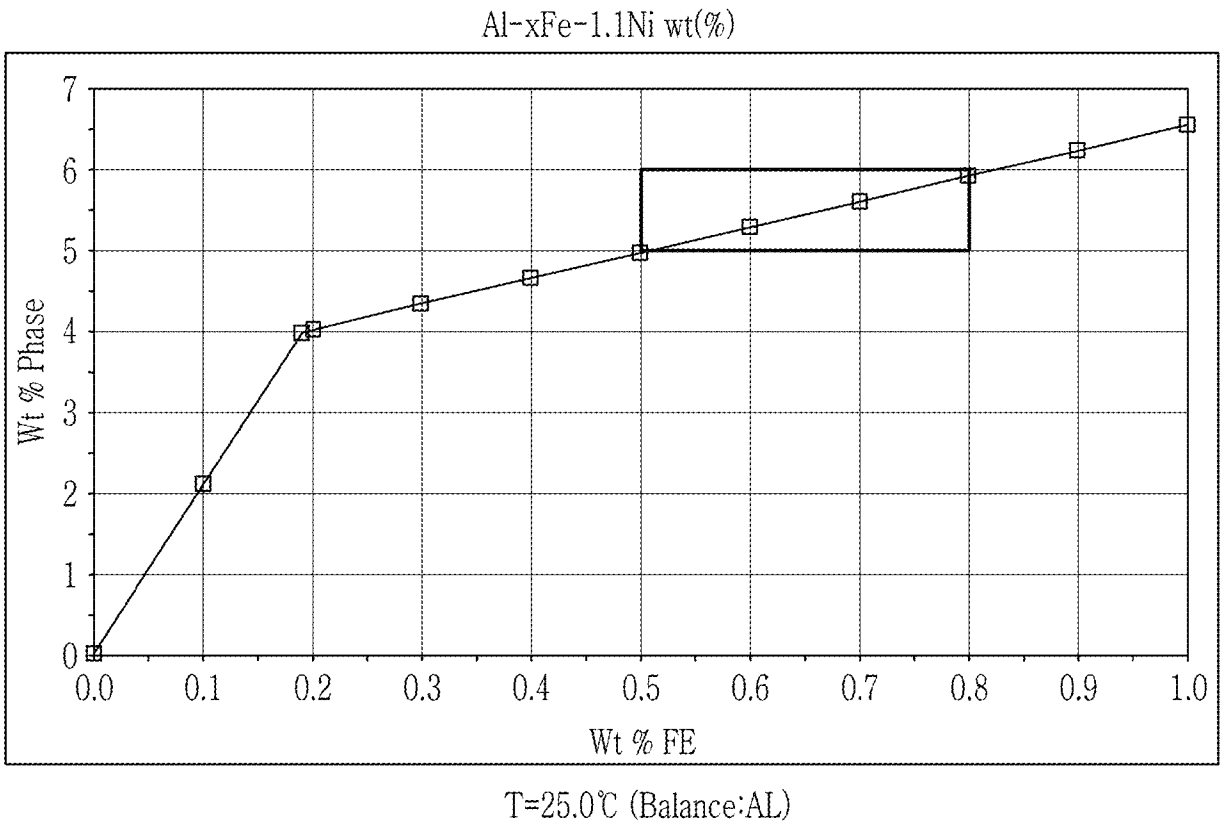
FIG. 3 illustrates a graph of a phase fraction of eutectic $FeNiAl_9$ according to a content of iron (Fe) when a content of nickel (Ni) is 1.1 wt %.
Figure 4:
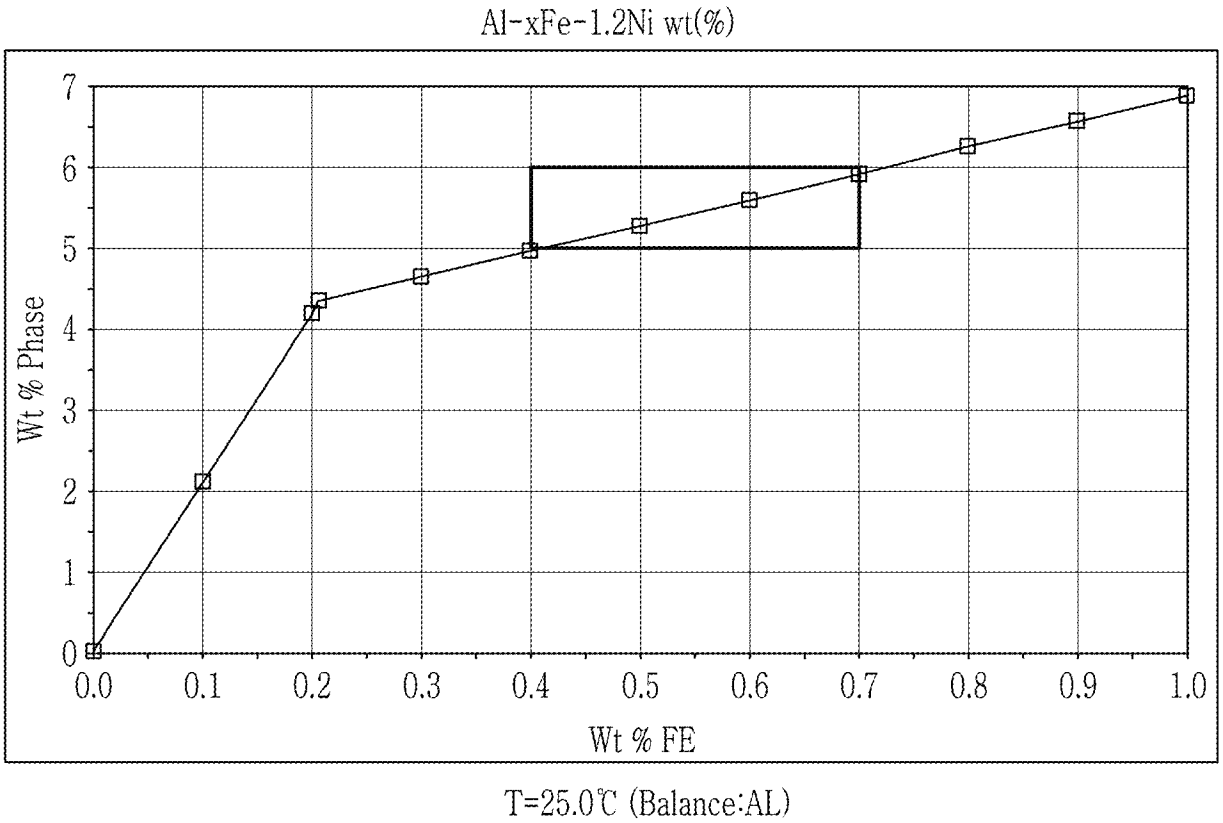
FIG. 4 illustrates a graph of a phase fraction of eutectic $FeNiAl_9$ according to a content of iron (Fe) when a content of nickel (Ni) is 1.2 wt %.
Figure 5:
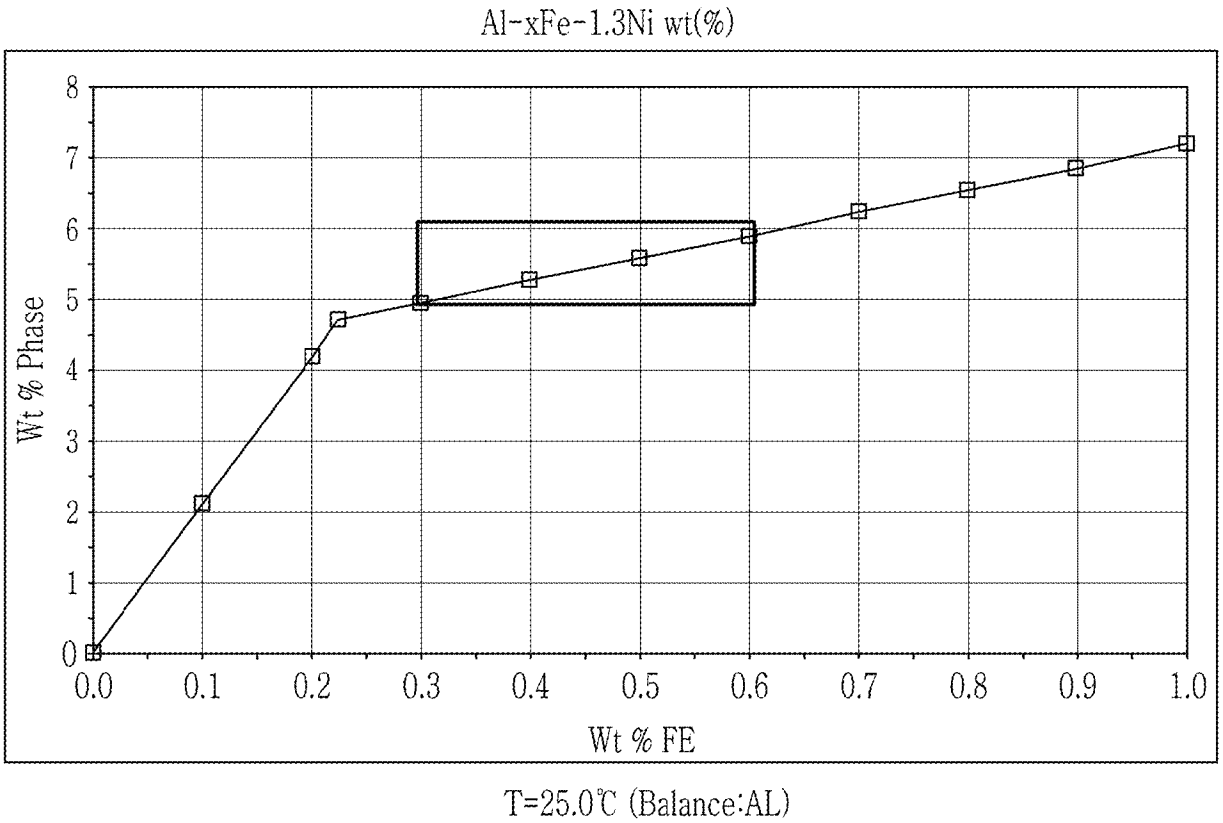
FIG. 5 illustrates a graph of a phase fraction of eutectic $FeNiAl_9$ according to a content of iron (Fe) when a content of nickel (Ni) is 1.3 wt %.

FIG. 1 illustrates a photograph of a microstructure of an Al—Ni—Fe—Mn-based alloy according to an embodiment of the present disclosure. This microstructure comprises or consists of an aluminum matrix phase, which is a primary phase, and an Al—$FeNiAl_9$ phase, which is a eutectic phase, and the $FeNiAl_9$ phase, which is the eutectic phase, is marked with dark areas in FIG. 1 and has a fine fibrous structure.

A sum (Ni+Fe) of the contents of the nickel and the iron may be 1.6 wt % or more.

Specifically, it may be 1.7 wt %, 1.8 wt %, or 1.9 wt % or more.

The sum (Ni+Fe) of the contents of the nickel and the iron may be 1.9 wt % or less.

Specifically, it may be 1.8 wt %, 1.7 wt %, or 1.6 wt % or less.

The eutectic $FeNiAl_9$ phase in the alloy may be 5 wt % or more.

Aluminum, nickel, and iron form the eutectic $FeNiAl_9$ phase in the alloy. When a sum range of the contents of the nickel and the iron is satisfied, the eutectic $FeNiAl_9$ phase may be generated at at least 5 wt % or more.

The sufficient casting properties may be secured when the eutectic $FeNiAl_9$ phase is present at at least 5 wt % or more in the alloy.

The fraction of the Al matrix phase in the alloy may be 94 wt % or more.

The fraction of the Al matrix phase in the alloy may be 95 wt % or less.

The matrix phase means a basic matrix phase configuring the microstructure.

As the eutectic $FeNiAl_9$ phase in the alloy increases, the thermal conductivity of the entire alloy decreases. Therefore, in order to secure the high thermal conductivity of 200 W/mK or more, the fraction of the Al matrix phase may or in some cases must be maintained at 94% or more. For this, the sum (Ni+Fe) of the contents of the nickel and the iron may or in some cases must be 1.9 wt % or less.

The iron content in the alloy may be equal to or less than the nickel content. When the iron content exceeds the nickel content, an additional $Al_3Fe$ phase is generated, so that the thermal conductive characteristic may be deteriorated.

The thermal conductivity of the alloy according to the embodiment of the present disclosure may be 200 W/mK or more. Specifically, it may be 201 W/mK, 204 W/mK, 205 W/mK, 207 W/mK, 209 W/mK, 210 W/mK, 211 W/mK, 215 W/mK, or 217 W/mK or more.

As described above, the alloy of the present disclosure has excellent and improved thermal conductivity, and cooling efficiency of parts and devices to which it is applied may be improved.

The thermal conductivity of the alloy according to the embodiment of the present disclosure may be 230 W/mK or less. Specifically, it may be 225 W/mK, 220 W/mK, 217 W/mK, or 210 W/mK or less.

The alloy according to another embodiment of the present disclosure may contain 0.1 to 0.4 wt % of manganese (Mn).

Manganese (Mn) may be combined with Fe and other elements (particularly, Cu, Si, etc.) to suppress these elements from being solidified and to allow the thermal conductivity to be additionally improved. In addition, workability may be improved through a hardness improvement.

The alloy according to another embodiment of the present disclosure further includes other alloy elements.

The other alloy elements refer to alloy elements other than aluminum (Al), nickel (Ni), and iron (Fe).

Specifically, the other alloy elements may include at least one of copper (Cu), magnesium (Mg), and silicon (Si).

The content of the other alloy elements may be 0.5 wt % or less based on the total amount of the alloy.

When the above-mentioned range is satisfied, the deterioration of the thermal conductivity due to the inclusion of other alloy elements may be prevented.

The content of copper (Cu) in the alloy may be less than 0.3 wt %. Specifically, an upper limit of the copper content may be 0.25 wt % or less, 0.2 wt % or less, 0.15 wt % or less, 0.1 wt % or less, or 0.05 wt % or less, and a lower limit of the copper content may be 0 wt % or more, may exceed 0 wt %, may be 0.05 wt % or more, 0.1 wt % or more, 0.15 wt % or more, or 0.2 wt % or more.

The content of copper (Cu) in the alloy may be 0.2 wt % or less. Specifically, it may be 0 to 0.2 wt %.

The content of magnesium (Mg) in the alloy may be 0.45 wt % or less. Specifically, an upper limit of the magnesium content may be 0.4 wt % or less, 0.35 wt % or less, 0.3 wt % or less, 0.25 wt % or less, 0.2 wt % or less, 0.15 wt % or less, 0.1 wt % or less, or 0.05 wt % or less, and a lower limit of the magnesium content may be 0 wt % or more, may exceed 0 wt %, may be 0.05 wt % or more, 0.1 wt % or more, 0.15 wt % or more, 0.2 wt % or more, 0.25 wt % or more, or 0.3 wt % or more.

The content of magnesium (Mg) in the alloy may be 0.3 wt % or less. Specifically, it may be 0 to 0.3 wt %.

The content of silicon (Si) in the alloy may be 0.33 wt % or less. Specifically, an upper limit of the silicon (Si) content may be 0.3 wt % or less, 0.25 wt % or less, 0.2 wt % or less, 0.15 wt % or less, 0.1 wt % or less, or 0.05 wt % or less. A lower limit of the silicon (Si) content may be 0 wt % or more, may exceed 0 wt %, and may be 0.05 wt % or more, 0.1 wt % or more, 0.15 wt % or more, 0.2 wt % or more, or 0.25 wt % or more.

The content of silicon (Si) in the alloy may be 0.3 wt % or less. Specifically, it may be 0 to 0.3 wt %.

When the content exceeds the above-mentioned range, the thermal conductivity of the alloy may be deteriorated.

Hereinafter, a manufacturing method of a high thermal conductive casting aluminum alloy are described. Descriptions that are duplicate to the contents of the high thermal conductive casting aluminum alloy described above have been omitted.

Manufacturing Method of High Thermal Conductive Casting Aluminum Alloy

A manufacturing method of the high thermal conductive casting aluminum alloy according to the embodiment of the present disclosure may include dissolving aluminum and adding iron (Fe) and nickel (Ni) to the dissolved aluminum.

When aluminum is first dissolved and then iron (Fe) and nickel (Ni) are added thereto, the iron (Fe) and nickel (Ni) with low or in some cases very low solubility may be stably alloyed to the aluminum to prevent segregation and to increase dissolution speed. Thus, it is possible to shorten a manufacturing time.

Specifically, after dissolving pure aluminum, iron (Fe) and nickel (Ni) are added in small portions to prepare an alloy.

However, this discloses an example of the present disclosure, and iron (Fe) and nickel (Ni) may be added to aluminum and then melted to produce the alloy.

The adding of the iron (Fe) and the nickel (Ni) may be include adding nickel (Ni) at 1.0 to 1.3 wt %, iron (Fe) at 0.3 to 0.9 wt %, and a balance of aluminum (Al) based on 100 wt % of the entire alloy.

Hereinafter, examples of the present disclosure and comparative examples will be described. However, the following examples are only examples of the present disclosure, and the present disclosure is not limited to the following examples.

Experimental Example 1: Evaluation of Contents of Nickel (Ni) and Iron (Fe) that Satisfies Casting Properties and High Thermal Conductivity FIG. 2, FIG. 3, FIG. 4, and FIG. 5 illustrate graphs of iron (Fe) contents to nickel (Ni) contents for simultaneously satisfying casting properties and high thermal conductivity. To obtain excellent casting properties, it is desirable or may be necessary to secure at least 5 wt % or more of the eutectic $FeNiAl_9$ phase.

However, in order to obtain the high thermal conductivity characteristic at the same time, the Al matrix phase fraction may or in some cases must also be at least 94 wt %. Thus, the result of calculating the iron (Fe) content for each nickel (Ni) content based on this is shown in Table 1. The boxes shown in FIGS. 2-5 are representative of the Fe content column in Table 1 for Examples 1-1 through 1-4.

TABLE 1

| | Content ratio (wt %) | | | Ni + Fe | $FeNiAl_9$ | Al |
|---|---|---|---|---|---|---|
| Classification | Al | Ni | Fe content section | content (wt %) | phase (wt %) | matrix (wt %) |
| Example 1-1 | Balance | 1 | 0.6-0.9 | 1.6-1.9 | 5-6 | 94-95 |
| Example 1-2 | Balance | 1.1 | 0.5-0.8 | 1.6-1.9 | | |
| Example 1-3 | Balance | 1.2 | 0.4-0.7 | 1.6-1.9 | | |
| Example 1-4 | Balance | 1.3 | 0.3-0.6 | 1.6-1.9 | | |

Experimental Example 2: Casting Property Evaluation Depending on Eutectic $FeNiAl_9$ Phase Fraction Table 2 summarizes a casting property result depending on a eutectic $FeNiAl_9$ phase fraction.

TABLE 2

| $FeNiAl_9$ Phase fraction | Classification | Chemical component (wt %) Al | Ni | Fe | Ni + Fe | Casting property evaluation result |
|---|---|---|---|---|---|---|
| Less than 5 wt % (Comparative Example 2) | Comparative Example 2-1 | Balance | 1 | 0.3 | 1.3 | 1.3-1.5 Unfilling or many hot cracks occur on a product due to a lack of fluidity |
| | Comparative Example 2-2 | Balance | 1.1 | 0.3 | 1.4 | |
| | Comparative Example 2-3 | Balance | 1.2 | 0.2 | 1.4 | |
| | Comparative Example 2-4 | Balance | 1.3 | 0.2 | 1.5 | |
| 5 wt % or more (embodiment 2) | Example 2-1 | Balance | 1 | 0.6 | 1.6 | 1.6-1.9 Filling and crack No |
| | Example 2-2 | Balance | 1.1 | 0.6 | 1.7 | |
| | Example 2-3 | Balance | 1.2 | 0.6 | 1.8 | |
| | Example 2-4 | Balance | 1.3 | 0.6 | 1.9 | |

When a sum (Ni+Fe) of contents of the nickel and the iron is less than 1.6 wt %, the eutectic $FeNiAl_9$ phase fraction is less than 5 wt %.

Figure 6:
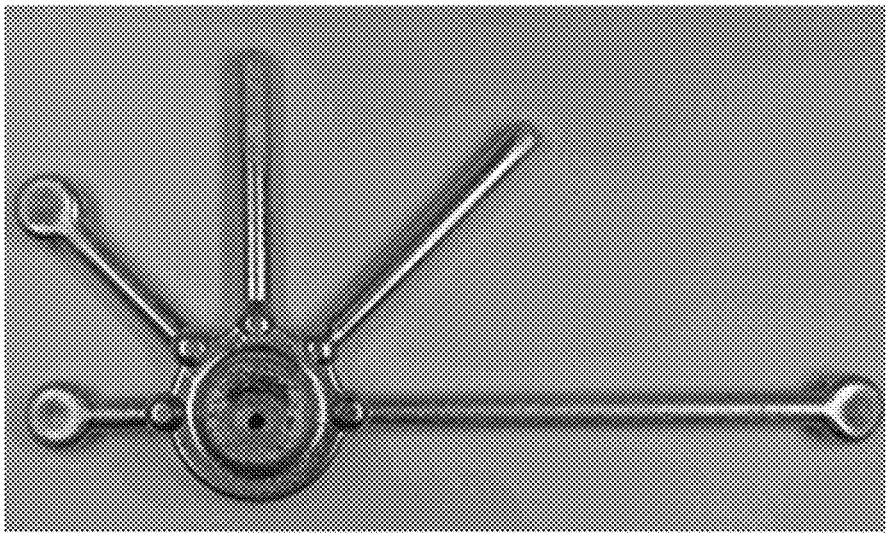
FIG. 6 illustrates an actual picture of a casting product when a phase fraction of $FeNiAl_9$ of Comparative Example 1 is less than 5 wt %.
Figure 7:
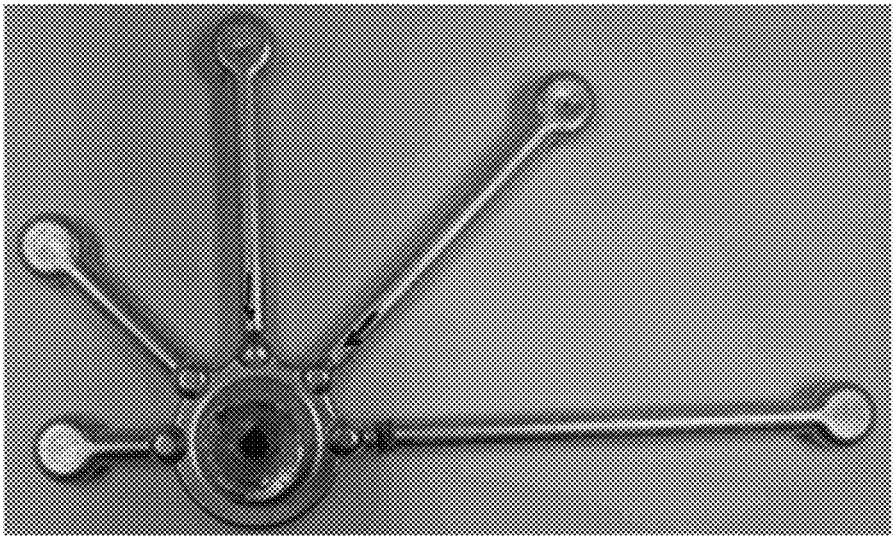
FIG. 7 illustrates an actual picture of a casting product when a phase fraction of $FeNiAl_9$ of Comparative Example 1 is less than 5 wt %.

FIG. 6 and FIG. 7 illustrate photographs of samples of Comparative Example 2-1 and Comparative Example 2-4, respectively. In the case of FIG. 6 and FIG. 7, it may be confirmed that the unfilling or the hot cracks occur in the product due to lack of fluidity of the alloy (see the arrows in FIG. 7).

When the sum (Ni+Fe) of the contents of the nickel and the iron is 1.6 wt % or more, 5 wt % or more of the eutectic $FeNiAl_9$ phase is produced.

Figure 8:
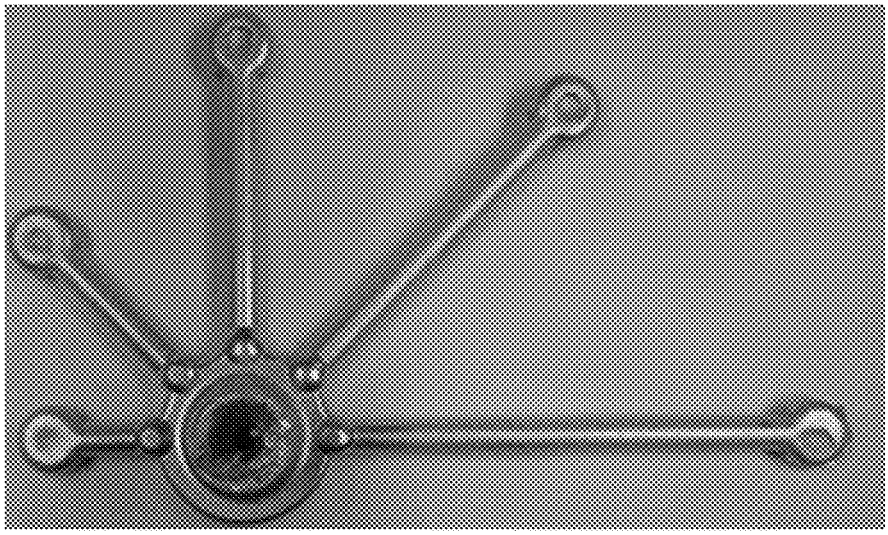
FIG. 8 illustrates an actual picture of a casting product when a phase fraction of $FeNiAl_9$ of Example 1 is equal to or larger than 5 wt %.
Figure 9:
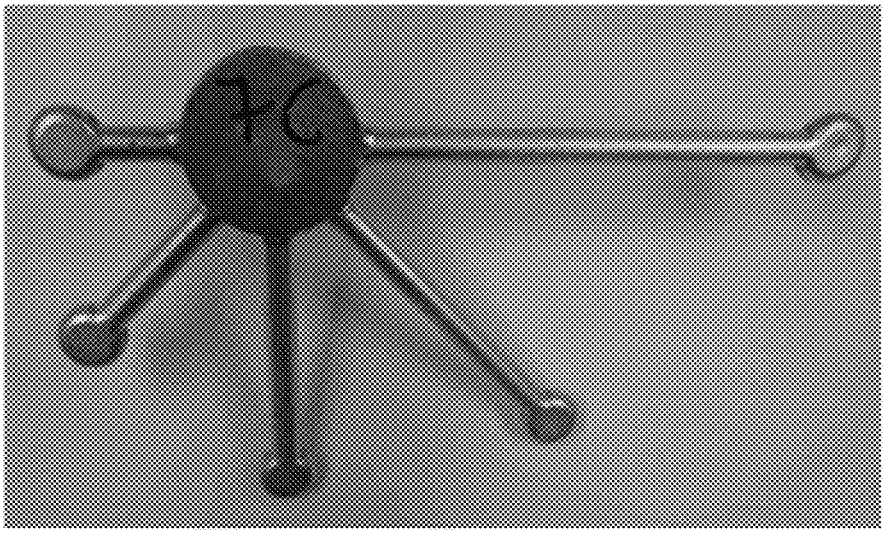
FIG. 9 in an actual picture of a casting product when a phase fraction of $FeNiAl_9$ of Example 2 is equal to or larger than 5 wt %.

FIG. 8 and FIG. 9 illustrate photographs of samples of Example 2-1 and Example 2-4, respectively. In the case of FIG. 8 and FIG. 9, it may be confirmed that the products may be manufactured without problems of the casting properties such as the unfilled products or hot cracks.

Experimental Example 3: Thermal Conductivity Evaluation Depending on Phase Fraction of Aluminum Matrix Table 3 summarizes a change in thermal conductivity depending on a phase fraction of an aluminum matrix.

TABLE 3

| Classification | Content ratio (wt %) Al | Ni | Ni + Fe | Al matrix phase fraction (wt %) | Thermal conductivity (W/mK) |
|---|---|---|---|---|---|
| Example 3-1 | Balance | 1 | 1.7 | 94.71 | 215 |
| Example 3-2 | Balance | 1 | 1.8 | 94.39 | 210 |
| Example 3-3 | Balance | 1 | 1.9 | 94.07 | 204 |
| Comparative Example 3-1 | Balance | 1 | 2 | 93.76 | 197 |
| Example 3-4 | Balance | 1.3 | 1.7 | 94.74 | 217 |
| Example 3-5 | Balance | 1.3 | 1.8 | 94.42 | 211 |
| Example 3-6 | Balance | 1.3 | 1.9 | 94.11 | 205 |
| Comparative Example 3-2 | Balance | 1.3 | 2 | 93.79 | 198 |

When the sum (Ni+Fe) of the contents of the nickel and the iron increases, the Al matrix phase fraction decreases and the thermal conductivity is deteriorated.

Therefore, in order to obtain a high thermal conductivity characteristic of 200 W/mK or more, which is a level of a wrought material, an Al matrix phase fraction of at least 94 wt % or more may or in some cases must be secured. For this, the sum (Ni+Fe) of the contents of the nickel and the iron may or in some cases must be managed to 1.9 wt % or less.

Experimental Example 4: Evaluation of Change in Thermal Conductivity Depending on Addition of Manganese Table 4 shows a change in thermal conductivity depending on addition of manganese.

TABLE 4

| Classification | Content ratio (wt %) Al | Ni | Ni + Fe | Mn | Thermal conductivity (W/mK) |
|---|---|---|---|---|---|
| Comparative Example 4-1 | Balance | 1 | 1.9 | 0 | 204 |
| Comparative Example 4-2 | Balance | 1 | 1.9 | 0.05 | 204 |
| Example 4-1 | Balance | 1 | 1.9 | 0.1 | 209 |
| Example 4-2 | Balance | 1 | 1.9 | 0.2 | 210 |
| Example 4-3 | Balance | 1 | 1.9 | 0.3 | 209 |
| Example 4-4 | Balance | 1 | 1.9 | 0.4 | 207 |
| Comparative Example 4-3 | Balance | 1 | 1.9 | 0.5 | 201 |

In the case of manganese, it may serve to further improve thermal conductivity by being combined with Cu, Si, and the like that are inevitably added to the aluminum alloy in addition to Fe.

As can be seen from Table 4, when manganese (Mn) at 0.1 wt % or more is included, the thermal conductivity is improved.

However, when manganese (Mn) exceeds 0.4 wt %, a problem of deteriorating the thermal conductivity occurs.

In addition, manganese (Mn) improves the surface hardness of the alloy, and thus improves the workability of the alloy.

Experimental Example 5: Evaluation of Influence of Other Alloy Elements on Al Matrix Phase Fraction FIG. 10, FIG. 11, and FIG. 12 show an Al matrix phase fraction depending on a content of each of copper (Cu), magnesium (Mg), and silicon (Si), which are other alloy elements.

Figure 10:
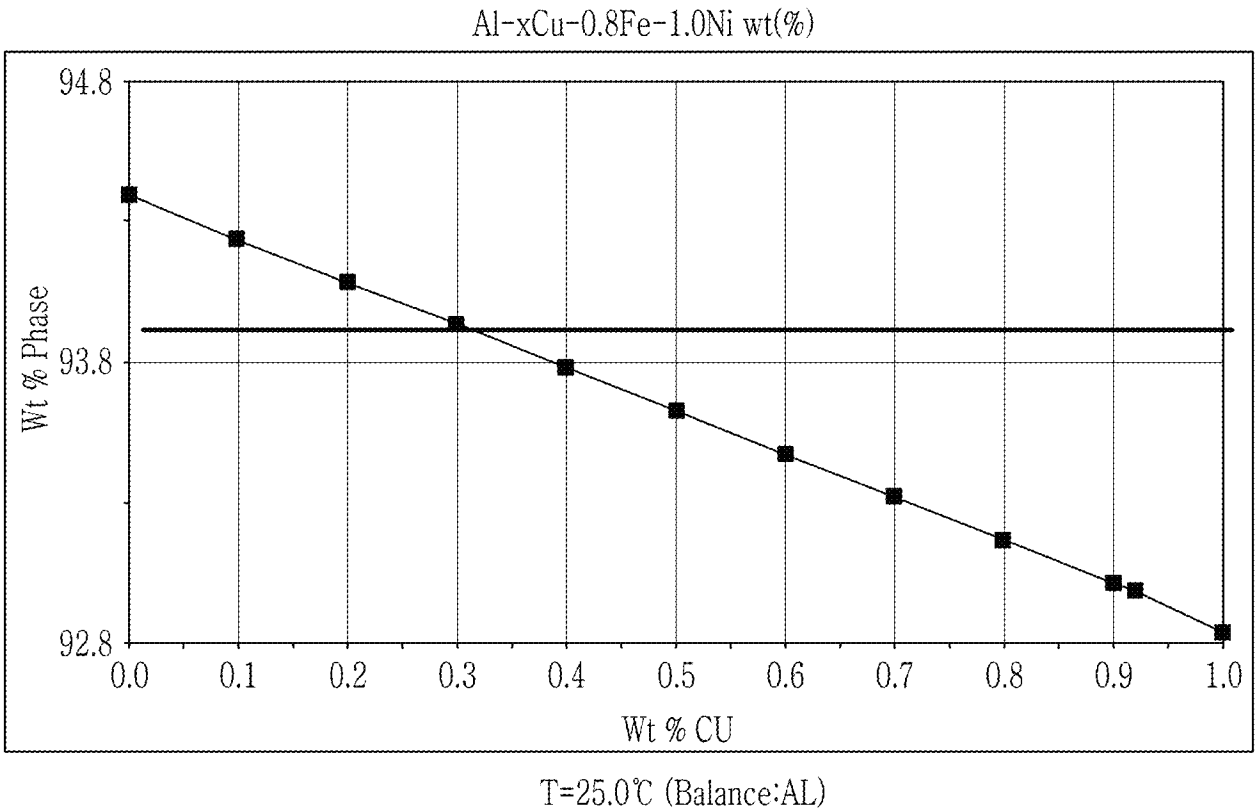
FIG. 10 illustrates a graph of a phase fraction of an aluminum (Al) matrix according to a copper (Cu) content.
Figure 11:
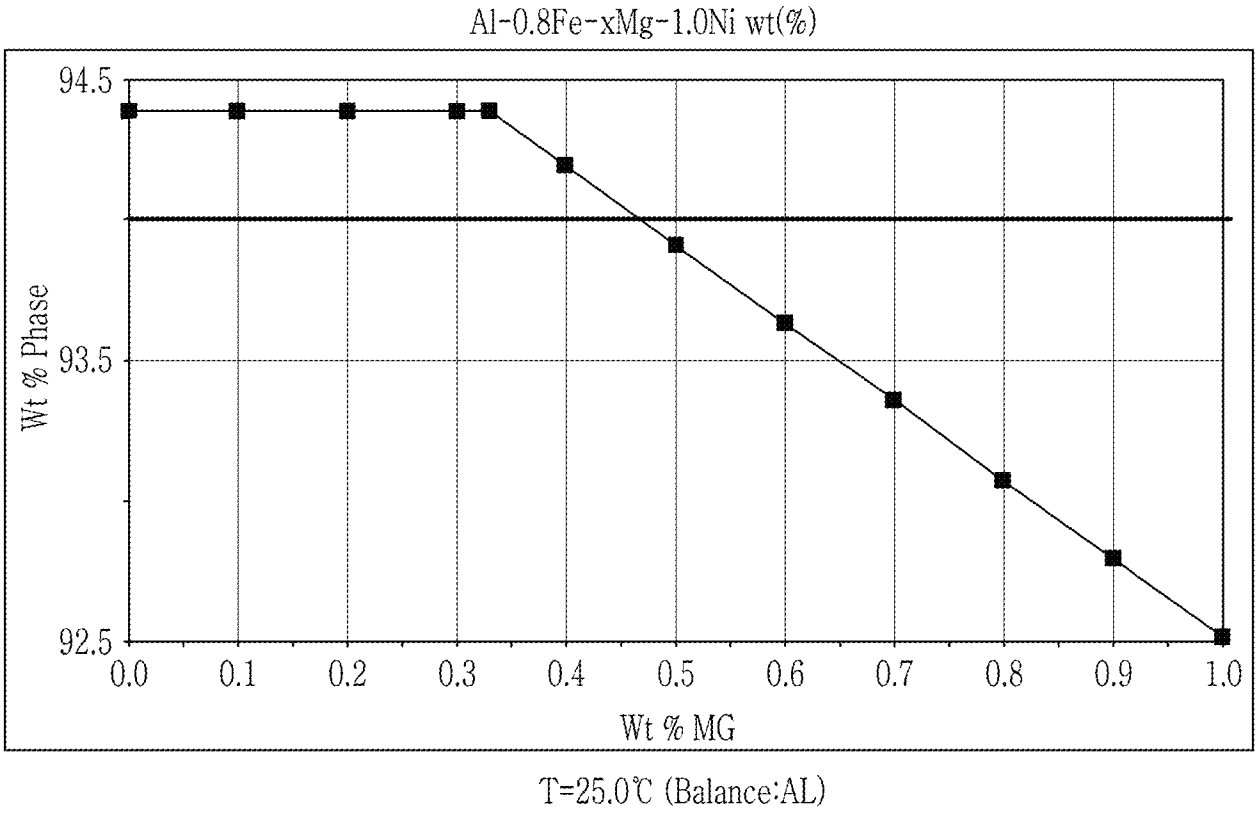
FIG. 11 illustrates a graph of a phase fraction of an aluminum (Al) matrix according to a magnesium (Mg) content.
Figure 12:
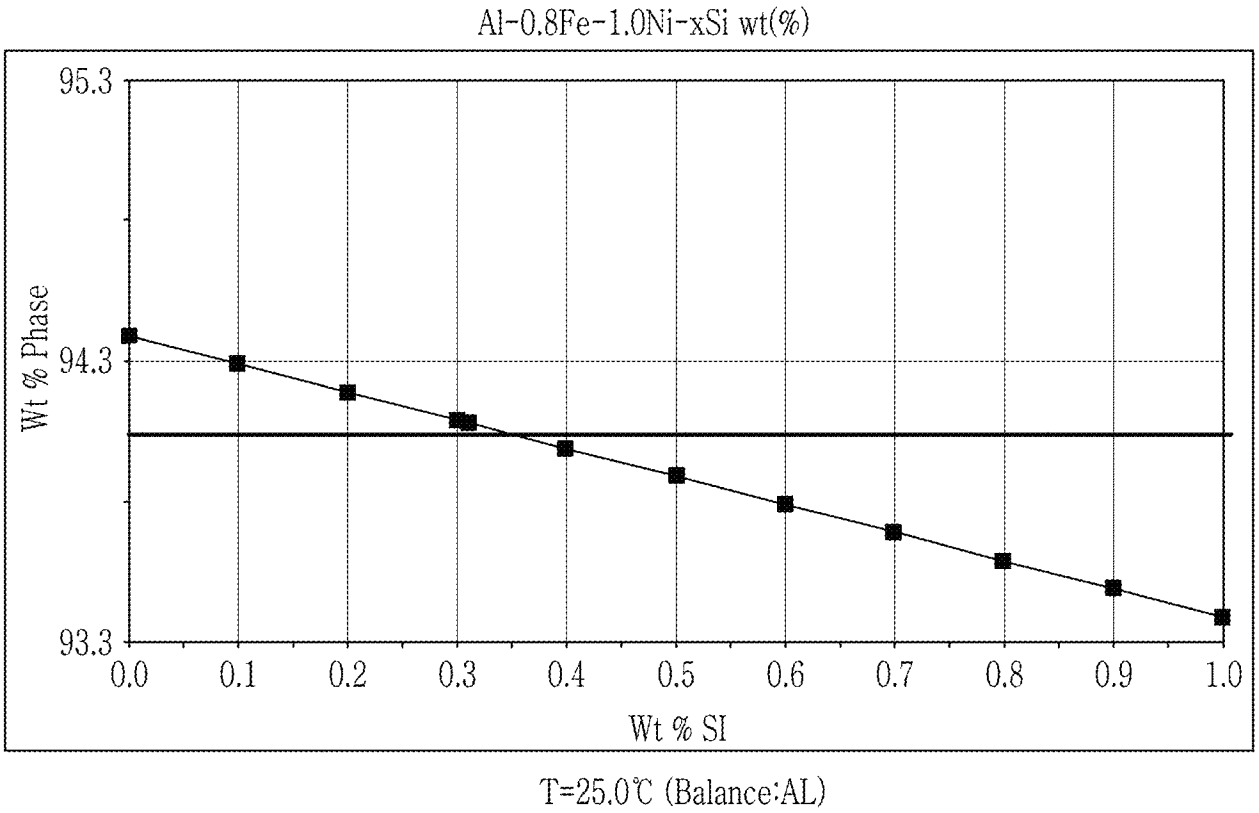
FIG. 12 illustrates a graph of a phase fraction of an aluminum (Al) matrix according to a silicon (Si) content.

As shown in FIG. 10, FIG. 11, and FIG. 12, reinforcing elements used in a general aluminum alloy such as copper (Cu), magnesium (Mg), and silicon (Si) decrease the thermal conductivity by decreasing the aluminum matrix phase fraction in an Al—Ni—Fe-based alloy.

Therefore, copper (Cu), magnesium (Mg), and silicon (Si) are or may be required to satisfy the following contents, respectively.

① Copper (Cu): 0.2 wt % or less

② Magnesium (Mg): 0.4 wt % or less

③ Silicon (Si): 0.3 wt % or less

④ Restriction of total impurity content: 0.5 wt % or less

As described above, it can be seen that the Al—Ni—Fe-based alloy of the present disclosure may reduce the manufacturing cost compared with a wrought material, may improve the thermal conductivity by 120% compared with a conventional casting aluminum alloy, and accordingly, may increase the cooling efficiency.

The present disclosure may be embodied in many different forms and should not be construed as being limited to the disclosed embodiments. In addition, it should be understood by those having ordinary skill in the art that various changes in form and details may be made thereto without departing from the technical spirit and essential features of the present disclosure. Therefore, it is to be understood that the above-described embodiments are for illustrative purposes only, and the scope of the present disclosure is not limited thereto.

What is claimed is:

1. A thermal conductive casting aluminum alloy as an Al—Ni—Fe-based alloy, comprising, based on an entire alloy of 100 wt %:

1.0 to 1.3 wt % of nickel (Ni);

0.3 to 0.9 wt % of iron (Fe);

0.1 to 0.4 wt % of manganese (Mn); and aluminum (Al) as a balance, wherein a eutectic $FeNiAl_9$ phase is 5 wt % to 6 wt % of the Al—Ni—Fe-based alloy, wherein a fraction of an Al matrix phase is 94 wt % to 96 wt % of the Al—Ni—Fe-based alloy, wherein a sum of contents of the Ni and the Fe is in a range of 1.6 wt % to 1.9 wt %, wherein a content of the Fe is less than a content of the Ni, and wherein a thermal conductivity of the Al—Ni—Fe-based alloy is 205 W/mK or more.

2. The thermal conductive casting aluminum alloy of claim 1, further comprising:

0.2 wt % or less of copper (Cu).

3. The thermal conductive casting aluminum alloy of claim 1, further comprising:

0.3 wt % or less of magnesium (Mg).

4. The thermal conductive casting aluminum alloy of claim 1, further comprising:

0.3 wt % or less of silicon (Si).

5. The thermal conductive casting aluminum alloy of claim 1, further comprising:

0.5 wt % or less of additional alloy elements based on a total amount of the Al—Ni—Fe-based alloy.

6. A manufacturing method of a thermal conductive casting aluminum alloy, the manufacturing method comprising:

dissolving aluminum (Al); and adding iron (Fe), nickel (Ni), and manganese (Mn) to the dissolved aluminum (Al), wherein a eutectic $FeNiAl_9$ phase is 5 wt % to 6 wt % of the alloy, wherein a fraction of an Al matrix phase is 94 wt % to 96 wt % of the alloy, wherein a sum of contents of the Ni and the Fe is in a range of 1.6 wt % to 1.9 wt %, wherein a content of the Fe is less than a content of the Ni, and wherein a thermal conductivity of the alloy is 205 W/mK or more.

7. The manufacturing method of claim 6, wherein the adding of the iron (Fe), the nickel (Ni), and the manganese (Mn) comprises adding 1.0 to 1.3 wt % of the nickel (Ni), 0.3 to 0.9 wt % of the iron (Fe), and 0.1 to 0.4 wt % of the manganese (Mn), wherein the aluminum (Al) is a balance of the alloy based on 100 wt % of the alloy.

8. The manufacturing method of claim 6, further comprising:

adding 0.2 wt % or less of copper (Cu), 0.3 wt % or less of magnesium (Mg), and 0.3 wt % or less of silicon (Si) to the dissolved aluminum (Al), based on an entire alloy of 100 wt %.

* * * * *